United States Patent [19]

Walla

[11] Patent Number: 4,761,978

[45] Date of Patent: Aug. 9, 1988

[54] LOCK WITH KEY OPERATED REMOVABLE PLUG

[75] Inventor: Gregg W. Walla, Lake Bluff, Ill.

[73] Assignee: Timberline Supply Ltd., Lake Bluff, Ill.

[21] Appl. No.: 874,419

[22] Filed: Jul. 25, 1986

Related U.S. Application Data

[63] Continuation-in-part of Ser. No. 765,843, Aug. 15, 1985.

[51] Int. Cl.[4] ..... E05B 29/00

[52] U.S. Cl. ..... 70/367; 70/371; 70/375; 70/380

[58] Field of Search ..... 70/367-369, 70/371, 375, 379 R, 380

[56] References Cited

U.S. PATENT DOCUMENTS

| | | | |
|---|---|---|---|
| 1,123,004 | 12/1914 | Prescott | 70/379 R X |
| 2,036,764 | 4/1936 | Lowe | 70/379 R X |
| 2,100,233 | 11/1937 | Beaumont | 70/379 R |
| 3,589,152 | 6/1971 | Glass | 70/371 |
| 4,068,510 | 1/1978 | Neary | 70/379 R |

*Primary Examiner*—Gary L. Smith
*Assistant Examiner*—Suzanne L. Dino
*Attorney, Agent, or Firm*—Wood, Dalton, Phillips, Mason & Rowe

[57] ABSTRACT

The lock comprises an improvement in a lock of the type having a cylinder with an associated internal cavity, a key operated lock plug rotatably mounted in the cylinder cavity and a coupling mounted for rotation relative to the lock cylinder for association with a lock member that is movable upon rotation of the coupling between locked and open states. Shoulders are provided on the plug and coupling and upon effecting relative rotation between the coupling and plug through a change key the shoulders can be selectively brought into interfering, facing relationship to prohibit withdrawal of the plug or misaligned to allow removal of the plug. An access key, that is longer than the change key, in a fully seated position in the plug keyway, extends into the coupling opening and is thereby keyed to the coupling so that turning of the control key directly operates the coupling. Structure is provided for preventing shifting of the lock member from its locked state in the absence of a key being in the keyway.

8 Claims, 2 Drawing Sheets

LOCK WITH KEY OPERATED REMOVABLE PLUG

CROSS REFERENCE

This application is a continuation-in-part of my earlier filed application Ser. No. 765,843, filed on Aug. 15, 1985 and entitled "Lock With Key Operated Removable Plug".

BACKGROUND ART

1. Field of the Invention

This invention relates to locks with removable plugs and, more particularly, to a lock with a plug that is removable from and insertable into a cylinder with a change key and operable by an access key that is longer than the change key and directly interconnects the plug with a lock coupling.

2. Background of the Invention

A known lock construction employs a key-operated plug that is rotatably mounted in a lock cylinder. The plug has a plurality of combinating tumblers normally radially biased outwardly into a longitudinal slot associated with the cylinder to prevent rotation of the plug within the cylinder cavity. The combinating tumblers read a properly bited key in the keyway and retract to allow rotation of the plug in the cylinder cavity. The assembled plug cooperates with a rotatable coupling that is in turn associated with a slide lock, a bolt, or other conventional type locking structure commonly used to secure sliding drawers, hinged doors and the like on office furniture, cabinets and similar.

It is desirable to have the plugs removable and interchangeable for the following reasons. In operations having large numbers of drawers, doors and the like that are regularly locked, it may be desirable to have common keying though the furniture may not be purchased at the same time or from a common source. For this reason, manufacturers of furniture find it convenient to provide a cylinder that is compatible with lock plugs manufactured by any of a number of different sources. The consumer need only insert a desired plug without having to change the entire locking system. The manufacturers of the furniture systems can therefore avoid involvement in the actual lock mechanism construction.

Another situation that makes interchangeability of plugs desirable is where the tenure of employees or tenants with keys is terminated. By replacing just the plug, future access through the lock can be prohibited without completely changing the locking system.

It is known, as exemplified in U.S. Pat. No. 4,398,405, to Patriquin, to provide two separate keys, one of which is termed a change key to allow removal of the plug and the other of which is commonly referred to as an access key to normally operate the plug between locked and unlocked positions. In Patriquin, a control tumbler is provided and seats in a slot formed directly in the cylinder to prevent the plug from being withdrawn. To operate the control tumbler, the change key has an extra bited portion to engage and retract the control tumbler and thereby allow removal of the plug from the cylinder.

One problem with the Patriquin structure is that the control tumbler is a thin, spring loaded disc. The disc and spring are susceptible to being broken, in which event the lock would malfunction.

The Patriquin structure is at the same time susceptible to being picked. By forcibly wedging out the plug, the control disc might be severed and the plug removed, thereby permitting access to the locked structure. Alternatively, the control disc might be withdrawn by an individual extending a wire or the like into the keyway. Little security is afforded by the Patriquin structure.

The Patriquin structure also presents problems from a manufacturing end. The slot that accepts the control tumbler or the stop against which the control tumbler bears is directly formed in the cylinder. It is very difficult and thereby costly to cast this structure directly in the cylinder.

Further, the requirement of the additional moving disc and associated biasing structure unduly complicates assembly. This is particularly true when the parts are small as they are in the lock plug. Further, the number of parts necessarily increases the likelihood of malfunction. Any malfunction of the control tumbler would render the lock ineffective for its purposes.

A still further drawback with the Patriquin and other conventional prior art locking system is that the change key must be in place in the keyway to assemble the plug in the cylinder. In large operations several master change keys may have to be made available to installers. It may therefore be difficult to keep track and/or prevent duplication of these master change keys. Loss of security for an entire operation may be lost requiring replacement of all plugs.

Another prior art structure that is susceptible to picking is shown in U.S. Pat. No. 2,036,764, to Lowe. Lowe discloses a coupled plug and adapter which are movable as a unit by an access key that extends through the plug keyway into the adapter. The plug is rotatable relative to the adapter by inserting a change key that is sufficiently short that it does not penetrate the adapter. To interconnect the plug and adapter, the change key is inserted with the plug and adapter in the FIG. 9 orientation and the plug is rotated relative to the adapter until the plug and adapter are relatively situated as in FIG. 5.

With the plug rotated through the key to the FIG. 3, or locked position, one can pick the lock by shifting the locking bolt, which rotates along with the adapter freely relative to the fixed plug. Consequently, the security afforded by the Lowe lock is minimal.

SUMMARY OF THE INVENTION

The present invention is specifically directed to overcoming the above enumerated problems in a novel and simple manner.

The present invention comprises an improvement in a lock of the type having a cylinder with an associated internal cavity, a key operated lock plug rotatably mounted in the cylinder cavity and a coupling mounted for rotation relative to the lock cylinder and in association with a lock member that is movable upon rotation of the coupling between locked and open states.

According to the invention, the plug end cooperates with the coupling in such a manner that shoulders on the coupling and plug interferingly face each other in a first position. Upon effecting relative rotation between the plug and coupling, the shoulders on the plug and coupling assume a second misaligned position, in which withdrawal of the plug from the cylinder can occur. The invention contemplates the use of keys of different length to effect insertion in and removal of the plug from the lock cylinder and operation of the plug. With a first, change key, the plug is rotatably movable with respect to the coupling to selectively align and misalign the cooperating shoulders on the coupling and plug. A second, longer key, an access key, in a fully seated position, penetrates an opening in the coupling and is keyed directly thereto so that relative rotational movement between the coupling and the plug is prohibited.

The invention contemplates direct interaction between the coupling and plug to prevent removal of the plug from the cylinder cavity. This structure positively maintains the plug in the lock cylinder. The applicant's lock, therefore, cannot be picked like the prior art locks and secures positively against unauthorized entry.

Another aspect of the invention is the provision of structure allowing snap-fitting of the plug and lock cylinder. Legs are provided on each of the plug and coupling members and each leg has an associated shoulder. Guiding surfaces associated with each of the legs on the coupling and plug encounter each other upon directing the plug into the lock cylinder. At least one of the guiding surfaces is ramped so that deflection of the legs occurs sufficiently to allow an axial overlapping position of the plug and coupling to be realized wherein the shoulders on each of the legs on the plug and coupling face each other interferingly. Accordingly, installation of the plug involves merely aligning the plug with the cavity and press fitting the same in place with or without a key present in the keyway associated with the plug. This facilitates placement of a large number of plugs which can be located and tapped into place with, for example, a hammer. As a result, an installer need not be given access to a change key. The security of the locking system can thus be assured.

A still further aspect of the present invention is the provision of structure for maintaining the lock member fixedly in its locked position with no key in the keyway. To accomplish this end, structure is provided so that the coupling can move rotatably relative to the plug in only one direction. With the lock mechanism in a locked state, rotation of the coupling relative to the plug in a direction opposite the one direction would be required to move the lock member from its locked to its unlocked state. Release of the lock member by rotation of the coupling relative to the plug with the lock member in its locked state is accordingly prohibited.

Other objects and advantages of the invention will become apparent upon reading the following detailed description taken in conjunction with the drawings and the appended claims.

DETAILED DESCRIPTION OF THE DRAWINGS

Figures 1, 2, 3, 4, 5, 6, 7, 8, 9, 10, 11, 12, 13, 14:
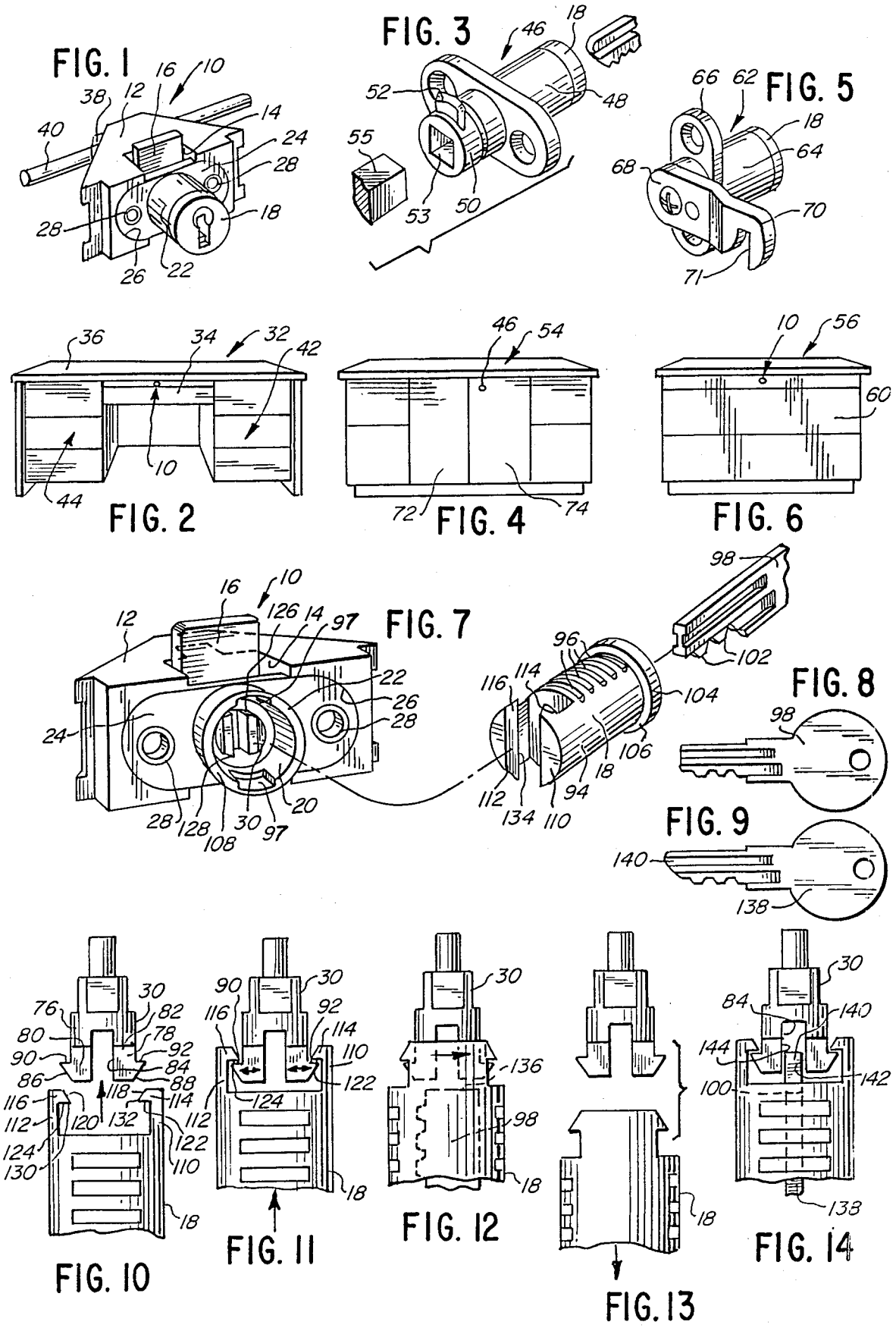
FIG. 1 is a perspective view of a first type of locking mechanism having a lock cylinder and removable plug wherein the incorporation of the present invention is appropriate.
FIG. 2 is a front view of a desk with a center drawer typically incorporating a locking mechanism such as that in FIG. 1.
FIG. 3 is a perspective view of a second type of conventional locking mechanism suitable for incorporation of the present invention.
FIG. 4 is a front view of a cabinet having center doors that typically have incorporated a locking mechanism such as that in FIG. 3.
FIG. 5 is a still further type of common conventional locking mechanism typically used to lock simple cabinet doors.
FIG. 6 is a front view of a cabinet wherein a lock such as that in FIG. 1 is incorporated on a stationary portion of the cabinet as opposed to incorporation on the door as in FIG. 4.
FIG. 7 is an exploded, perspective view of the locking mechanism of FIG. 1 with the present invention incorporated.
FIG. 8 is a side elevation view of a change key used to remove the plug from and replace the plug in the locking mechanisms of FIGS. 1, 3 and 5.
FIG. 9 is a side elevation view of an access key used to lock and unlock the mechanisms of FIGS. 1, 3 and 5.
FIG. 10 is an exploded view of a snap-fit connection between the coupling and lock plug.
FIG. 11 is a view similar to that in FIG. 10 with the coupling and plug assembled.
FIG. 12 is a view similar to that in FIG. 11 with the key of FIG. 8 in the keyway of the plug rotated 90° from the FIG. 11 position so that relative rotation can occur between the coupling and plug.
FIG. 13 is a view similar to that in FIG. 10 with the coupling and plug positioned for assembly and relatively rotated 90° away from the positions of FIGS. 10 and 11.
FIG. 14 is a view similar to that in FIG. 13 with the plug and coupling assembled and the key of FIG. 9 inserted and drivingly penetrating an opening associated with the coupling.
Figure 15:
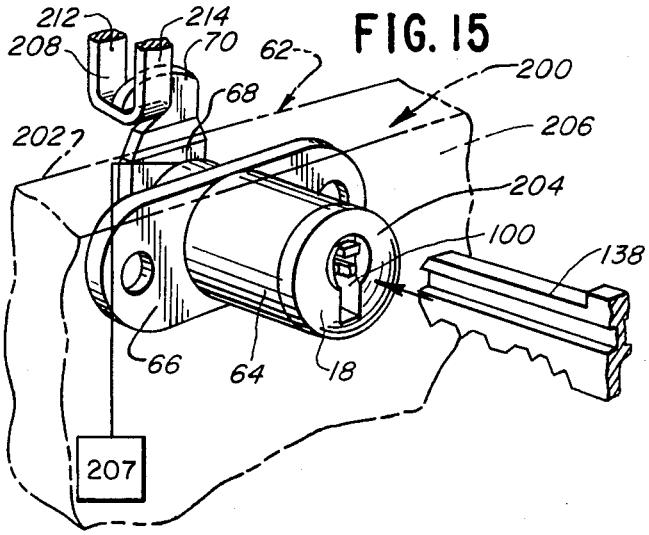
FIG. 15 is a perspective view of a locking mechanism according to the present invention with an associated lock member in its lock state.
Figure 16:
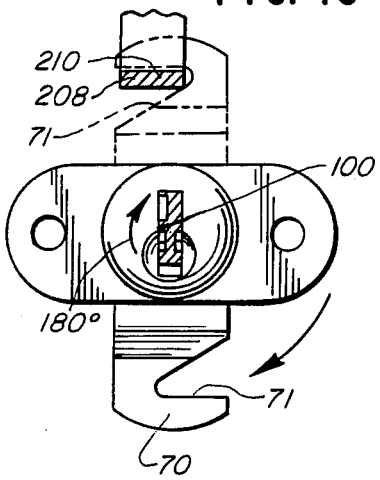
FIG. 16 is a front elevation view of the locking mechanism in FIG. 15 with the plug and associated lock member rotated through 180° from the FIG. 15 position to an unlocked state.

A typical lock mechanism to which the present invention is particularly adaptable is shown in FIGS. 1 and 7 at 10. The mechanism 10 comprises a V-shaped housing 12 having a rectangular cut-out 14 through which a rectangular bolt 16 is vertically movable in response to rotation of a lock plug 18. The lock plug is fit in a cavity 20 internally of a cylinder 22 which is integrally formed with a mounting plate 24. The mounting plate is accepted in a conforming undercut 26 in the housing and is maintained on the housing by a pair of rivets 28.

Associated with the lock cylinder 22 is a coupling 30 mounted for rotation about an axis coincident with the axis of the cylinder 22. The coupling is connected to an eccentric pin (not shown) which moves in a horizontal slot (not shown) in the bolt 16. Through the action of the pin in the slot upon rotation of the coupling 30, the bolt 16 is caused to extend and retract as desired. Typically, the locking mechanism 10 is associated with a desk as shown at 32 in FIG. 2. The desk 32 has a narrow rail above the center drawer 34 that is bored to closely accept the cylinder 22. Upon operating the lock, the bolt 16 can be selectively extended into a downwardly opening slot (not shown) associated with the desk top 36 to prevent opening of the drawer 34 and withdrawn to allow the drawer to be slidingly opened.

In one known construction, the bolt has an associated toothed rack (not shown) which meshes with a peripherally toothed disc 38 keyed to rotate with a cable 40. The end of cable 40 can be directed to operate a remote locking module, typically associated with a column of drawers as at 42, 44 in FIG. 2. The precise operation of the locking mechanism on the drawers is not critical to the present invention. It suffices to say that such structures may have a vertically adjustable slide bar movable through the mechanism 10 to selectively align and misalign lugs thereon with stops on the drawers to either prevent or allow withdrawal of the drawers.

In FIG. 3, an alternative locking mechanism is shown at 46. The mechanism 46 comprises a cylinder 48 with an associated plug 18 that directly rotates a latch member 50 having an integral lug 52 that can be either aligned within a slot (not shown) associated with a drawer or door or rotated to move the lug 52 out of the slot to allow drawer or door operation. An opening 53 with a cross-section matched to a cable 55 for keyed connection therewith is optionally provided in the catch 50. The cable can be connected to a remote operator similarly to the cable 40 in FIG. 1.

The mechanism 46 is typically associated with a cabinet such as that shown at 54 in FIG. 4 with a set of doors between sets of drawers. An alternative cabinet configuration suitable for incorporation of the mechanism 10 is shown at 56 in FIG. 6 and has a pair of slidable drawers 60.

A still further representative lock mechanism is shown in FIG. 5 at 62. The mechanism comprises a cylinder 64 and associated, integral mounting plate 66. The cylinder defines a cavity for rotatable reception of a lock plug 18. The lock plug 18 is connected to a latch member 68 having a hook 70 offset from the latch axis that can be used to lockingly engage a pin (not shown). The structure 62 is typically incorporated into a cabinet such as that in FIG. 4 to interlock adjacent, oppositely opening doors 72, 74. With the doors closed and the latch member 68 rotated to seat the pin in the hook opening 71, pivoting of either door 72, 74 is prohibited.

It should be understood that all three different types of mechanisms are only exemplary of those into which the present invention might be incorporated. It is contemplated that the inventive structure might be incorporated into other types of locking mechanism as well. The inventive structure will now be described with respect to the representative lock mechanism shown in FIG. 1 and detailed in FIGS. 7 and 10–14.

The invention resides principally in the novel cooperating structure on the coupling 30 and plug 18. The coupling 30 has a conventional stepped configuration, which is not critical to the present invention. The thickest body portion 76 is journalled for rotation in a bore (not shown) in the mounting plate 24 so that the forward portion 78 of the coupling protrudes into the cavity 20 associated with the lock cylinder 22. The forward portion 78 of the coupling 30 is bifurcated to define legs 80, 82 which bound therebetween a space 84. Each leg has a ramped guiding surface 86, 88 that diverges from front to rear. At the rear edge of the guiding surfaces 86, 88 are rearwardly facing shoulders 90, 92. The conventional part of the plug 18 comprises a cylindrical body 94 with tumblerways 97 guiding movement of disc-like combinating tumblers (not shown). With the key 98 removed from a keyway 100 extending axially the length of the plug 18, the tumblers are biased radially into slots 96 associated with the cylinder 22 to prevent rotation of the plug 18 within the cylinder 22. The key 98 is called a change key and has a plurality of bites 102 which are read by the tumblers (not shown) and with the key 98 fully inserted retract the tumblers to allow rotation of the plug in the cylinder cavity 20. The cooperation of the key 98 with the combinating tumblers is conventional.

The plug 18 has an enlarged head 104 defining a shoulder 106 that bears on a forward, annular edge 108 on the cylinder 22 with the plug in a fully seated position. The plug has spaced legs 110, 112 with radially inwardly directed offsets 114, 116 respectively having ramped guiding surfaces 118, 120 diverging from front to rear and shoulder surfaces 122, 124 facing forwardly of the plug 18.

The invention contemplates two different methods of assembling the plug and coupling. In FIGS. 10 and 11, a snap-fit connection is demonstrated. In FIG. 10, the plug and coupling are shown axially aligned for assembly. To effect assembly, the plug and coupling are directed axially towards each other causing the guiding surfaces 118, 120 on the plug 18 to encounter the guiding surfaces 86, 88 on the coupling. The ramped surfaces cooperate with each other to deflect the legs 80, 82 on the coupling radially inwardly toward each other and simultaneously the legs 110, 112 on the plug radially outwardly away from each other. This allows an axial overlapping position of the coupling and plug to be effected. Upon the fully seated plug position being realized, as shown in FIG. 11, the legs on both the coupling and plug assume their undeflected state, causing the coupling shoulders 90, 92 to face interferingly against the shoulders 122, 124 of the plug to prevent relative axial movement between the plug and coupling. This can be accomplished with or without a key in place in the keyway. The above arrangement facilitates rapid assembly of large numbers of plugs. For example, one can place the plug in the cylinder cavity and seat the plug with a sharp rap from a hammer.

Preferably, both the coupling and body are made from a die cast metal, which permits the modicum of flexing required to effect assembly of the coupling and plug. It is within the scope of the invention to make one or the other of the coupling and plug of a different, more deformable material than the other so that one of the plug and coupling deforms upon the plug being inserted and the other of the plug and coupling remains rigid.

The second method of assembling the plug and coupling according to the invention will be described with respect to FIGS. 7 and 12–14. The legs 80, 82 on the coupling have oppositely facing flat sides 126, 128. Accordingly, the arcuate shoulders 90, 92 defined on the legs each extend less than 180° about the coupling. The dimension between the flat sides 126, 128 is less than the spacing between the forward extremities 130, 132 of the ramped guiding surfaces 118, 120 on the plug 18, between which extremities a radial slot 134 is defined.

To assemble the plug and cylinder, the change key 98 is inserted into the keyway 100 to retract the combinating tumblers. With the key 98 fully seated in the plug, the leading edge 136 of the key terminates axially short of the legs 110, 112 on the plug and therefore short of the coupling in assembled relationship of the plug shown in FIG. 12. Further, the plane of the key is situated transversely to the length of the space 84 between the coupling legs. With the coupling and plug in the FIGS. 12 and 13 alignment, the plug can be extended fully into the cylinder cavity and removed therefrom without interference.

To effect locking of the plug against axial shifting within the cylinder cavity, the plug is rotated relative to the coupling in either direction through 90°. This moves the shoulders on the coupling and plug so that they face each other interferingly as in FIG. 11 and withdrawal of the plug from the cylinder cavity is prohibited. In the locked position, the plane of the key 98 aligns parallel with the length of the space between the legs of the coupling. Upon removal of the key 98, the combinating tumblers seat selectively in the slots to prevent rotation of the plug in the cylinder cavity so that the plug is simultaneously fixed against rotational and axial movement relative to the cylinder 22.

The key 98, because it does not extend into engagement with the coupling, cannot effect movement thereof. Accordingly, an access key 138 is provided and is longer than the change key 98. As seen in FIG. 14, with the plug and coupling locked together, the access key 138 can be extended fully into the plug so that the end portion 140 penetrates the space 84 between the coupling legs. The access key cooperates with the edges 142, 144 of the legs defining the opening 84 so that the coupling follows rotational movement of the key 138. The key 138 prohibits relative rotational movement between the plug and coupling to prevent inadvertent assumption of the separating positions of FIGS. 12 and 13. The direct engagement of the key 138 and coupling assures that the force applied to the key is transmitted positively to the coupling.

FIGS. 15–20 demonstrate one particular application of the locking mechanism at 62 of FIG. 5 and further shows structure for preventing picking of the lock. The locking mechanism at 62 is shown mounted to a drawer or the like at 200. The back side 202 of the drawer facially accepts the mounting plate 66, which is secured thereto as by bolts or the like (not shown). The lock cylinder 64 has an axial length at least equal to the thickness of the drawer 200 and projects forwardly through a bore so that the front portion 204 of the lock plug 18 is exposed at the front surface 206 of the drawer 200. Upon insertion of the access key 138 into the keyway 100, the latch member 68, with associated hook 70, is pivotable from the locked position, depicted in FIG. 15, through 180° in a clockwise direction in FIGS. 15 and 16, to the position shown in FIG. 16. Rotation through a full 180° may not be required. The latch member 68 is confined by conventional structure on the lock cylinder between the extreme positions of rotation in FIGS. 15 and 16. The confining structure is shown schematically and identified by reference numeral 207 in FIG. 15.

A portion of an exemplary latching hook 208 is shown having a U-shaped configuration with a base 210 and upstanding legs 212, 214. Rotation of the latch member 68 from its FIG. 16 position counterclockwise moves the latch member 68 against the latching hook 208 so that the base 210 situates in the hook opening 71, in which position the hook 70 interferes with the hook 208 to prohibit withdrawal of the drawer.

Figure 17:
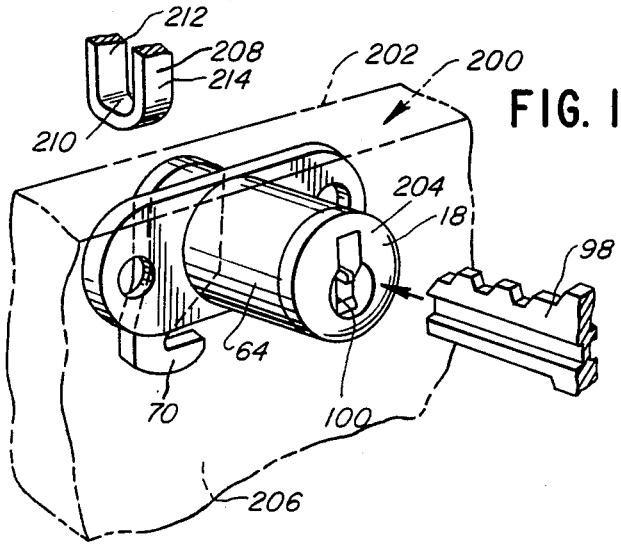
FIG. 17 is a perspective view of the locking mechanism in the FIG. 16 state in combination with a change key.

The procedure for removal of the lock plug is demonstrated in FIGS. 17–20. In FIG. 17, the lock mechanism is shown in its unlocked position, wherein the hook 70 is pivoted away from the latching hook 208 to its downwardmost position. In this position, the plug legs 110, 112 assume the orientation shown in phantom in FIG. 20 relative to the spaced coupling legs 80, 82.

According to the invention, the coupling legs 80, 82 have radially outwardly facing edges 216, 218, respectively. The edges 216, 218 have curved portions 220, 222, respectively, at diametrically opposite positions with respect to the rotational axis 224 for the coupling and plug. The edges 216, 218 have flat portions 230, 232, respectively, which align with facing surfaces 234, 236 on the plug with the lock mechanism unlocked.

Upon insertion of the change key 98 and rotation of the plug through the change key clockwise 90° relative to the coupling from the FIG. 17 position, the coupling legs 80, 82 are guided through the curved portions 220, 222 of the edges 216, 218 against the surfaces 234, 236. The plug can be separated from the lock cylinder with the plug and coupling relatively positioned as in FIGS. 19 and 20.

Figure 18:
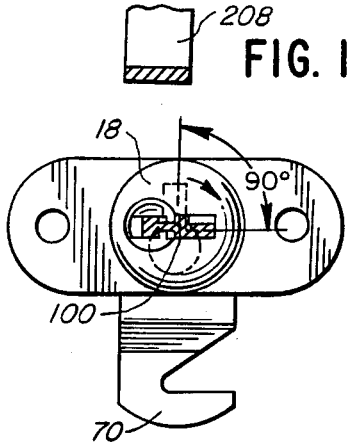
FIG. 18 is a front elevation view of the locking mechanism in FIGS. 15–17 with the plug rotated relative to coupling by the change key 90° from the FIG. 17 orientation to a position wherein the plug can be separated from the locking mechanism.
Figure 19:
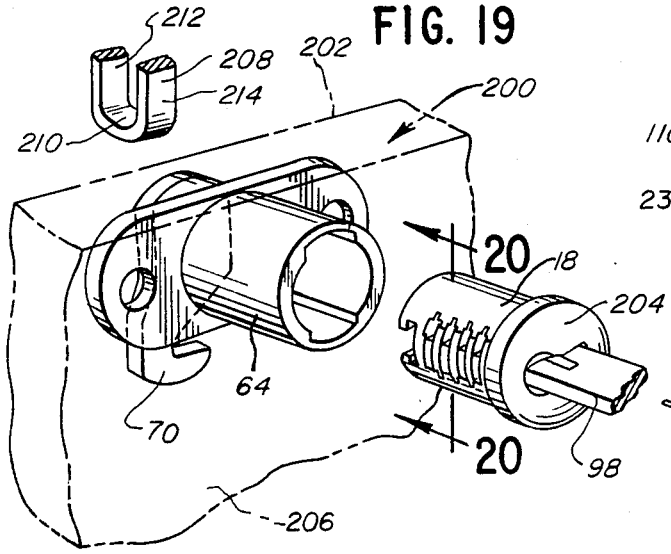
FIG. 19 is a perspective view of the locking mechanism as in FIG. 18 with the change key inserted in the plug and the plug separated from the lock cylinder.
Figure 20:
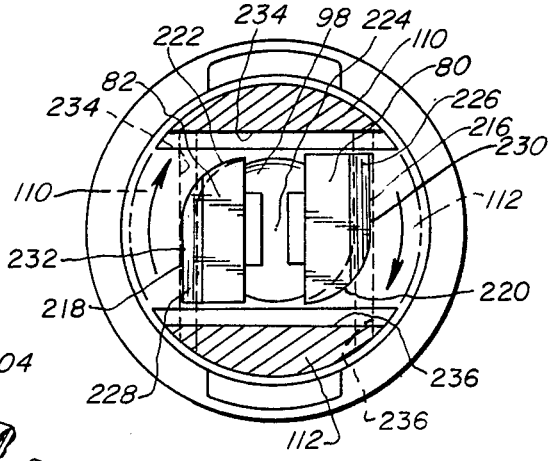
FIG. 20 is a sectional view of the plug with a key inserted along line 20—20 of FIG. 19 and with the plug inserted in the lock cylinder.

To reassemble the plug, the change key 98 is inserted in the keyway in the plug and directed into the chamber of the lock cylinder with the lock cylinder and plug relatively oriented as shown in FIGS. 18–20. Upon the plug being fully extended into the cylinder, the plug is rotated counterclockwise through 180°. The plug legs bear on the coupling legs and draw the coupling through the same range of rotation so that the hook 70 is in its upright and locked position with the coupling legs as shown in FIG. 20. Further rotation of the plug in a counterclockwise direction relative to the coupling causes the surfaces 234, 236 to encounter the curved portions 220, 222, which guide the plug into the phantom position shown in FIG. 20 relative to the coupling legs. There is a camming action as the plug realizes the phantom position in FIG. 20. Movement of the plug relative to the coupling in the counterclockwise direction is facilitated by reason of the latch member 68 being confined against further counterclockwise rotation.

Upon withdrawing the key, it can be seen that the latch member is effectively fixed in its locked position and rotation of the latch member must be accomplished by inserting the key and rotating the entire plug. Attempted rotation of the coupling legs clockwise in FIG. 20 in the absence of a key brings abutting surfaces 226, 228 interferingly against the facing surfaces 234, 236 on the plug. Thus it is impossible for an individual to pry the latch member 68 from its locked position without using a key.

The foregoing description was made for purposes of demonstrating the structure and operation of the present invention, with no unnecessary limitations to be understood therefrom.

I claim:

1. In a lock having a lock cylinder provided with an internal cavity, a key operated lock plug having a keyway, said lock plug being removably mounted in said lock cylinder cavity to be rotatable about a first axis relative to the lock cylinder with a key inserted in said keyway and locked against rotation in said cavity in the absence of a key in the keyway, and a coupling rotatably mounted in said lock cylinder for rotation about said first axis and having associated therewith a lock member that is movable upon rotation of the coupling in a limited range between a locked state and an open state with the coupling in locked and unlocked positions respectively, the improvement comprising:

means provided on the plug for cooperation with the coupling selectively to prevent withdrawal of the plug from the cavity with the plug inserted fully into the cavity and the plug and coupling being disposed in a first relative rotational position, and to allow withdrawal of the plug from the cavity with the plug inserted fully into the cavity and the plug and coupling in a second relative rotational position, said coupling having spaced edges defining an opening extending axially with respect to the lock cylinder;

a first key having a length preselected so that when said first key is in a fully inserted position in the keyway a portion of the first key extends into said coupling opening so that rotation of the first key brings said key portion into contact with one of said spaced edges to effect rotation of the coupling;

a second key having a length such that when the second key is fully inserted in the keyway it does not extend into the opening, whereby with said second key relative rotation between the plug and coupling can be effected between the first and second relative rotational positions; and means for preventing rotation of the coupling in either direction relative to the plug with the coupling in the locked position, whereby the lock member cannot be moved from its locked state to its open state without insertion of a key in the keyway.

2. The lock according to claim 1 wherein means are provided for frictionally biasing the means on the plug and coupling against each other upon the coupling and plug being moved from said first relative rotational position to said second relative rotational position.

3. The lock according to claim 1 wherein said plug has a pair of spaced legs, said coupling has a pair of spaced legs and the pair of spaced legs on one of the plug and coupling resides between the pair of spaced legs on the other of the plug and coupling with the plug in place on the lock cylinder.

4. The lock according to claim 1 wherein said plug has a pair of spaced legs, said coupling has a pair of spaced legs and the pair of spaced legs on one of the plug and coupling resides between the pair of spaced legs on the other of the plug and coupling with the plug in place on the lock cylinder, means are provided on the pair of legs on the one of the plug and coupling to guide rotation of the one of the plug and coupling in a first rotational direction relative to the other of the plug and coupling in moving between said second relative rotational position and said first relative rotational position and means are provided to prevent rotation of the one of the plug and coupling relative to the other of the plug and coupling in a rotational direction opposite to said first rotational direction in moving between said second relative rotational position and said first relative rotational position.

5. The lock according to claim 1 wherein said plug has a pair of spaced legs, said coupling has a pair of spaced legs and the pair of spaced legs on one of the plug and coupling resides between the pair of spaced legs on the other of the plug and coupling with the plug in place on the lock cylinder, means are provided on the pair of legs on the one of the plug and coupling to guide rotation of the one of the plug and coupling in a first rotational direction relative to the other of the plug and coupling in moving between said second relative rotational position and said first relative rotational position and means are provided to prevent rotation of the one of the plug and coupling relative to the other of the plug and coupling in a rotational direction opposite to said first rotational direction in moving between said second relative rotational position and said first relative rotational position, said means for guiding rotation comprising a curved edge on at least one of the legs of the pair of legs on the one of the plug and coupling for progressively biasing the one of the legs against a leg of the leg pair on the other of the plug and coupling as the plug and coupling are moved between said second relative rotational position and first relative rotational position upon rotation of the one of the plug and coupling in the first rotational direction thereof.

6. The lock according to claim 1 wherein said plug has a pair of spaced legs, said coupling has a pair of spaced legs and the pair of spaced legs on one of the plug and coupling resides between the pair of spaced legs on the other of the plug and coupling with the plug in place on the lock cylinder, means are provided on the pair of legs on the one of the plug and coupling to guide rotation of the one of the plug and coupling in a first rotational direction relative to the other of the plug and coupling in moving between said second relative rotational position and said first relative rotational position and means are provided to prevent rotation of the one of the plug and coupling relative to the other of the plug and coupling in a rotational direction opposite to said first rotational direction in moving between said second relative rotational position and said first relative rotational position wherein said means for preventing rotation comprising an abutting edge on at least one of the legs of the pair of legs on the one of the plug and coupling, said abutting edge interfering with a leg of the leg pair on the other of the plug and coupling as the one of the plug and coupling is urged rotatably relative to the other of the plug and coupling in a direction opposite said first rotational direction with said plug and coupling in the second relative rotational direction.

7. In a lock of the type having a lock cylinder provided with an internal cavity, a key operated lock plug having a keyway, said lock plug being removably mounted in said lock cylinder cavity to be rotatable about a first axis relative to the lock cylinder with a key inserted in said keyway and locked against rotation in the chamber in the absence of a key in the keyway and a coupling rotatably mounted in the lock cylinder for rotation about said first axis relative to the lock cylinder and having associated therewith a lock member that is movable in a prescribed range between a locked state at one extreme of said prescribed range and an open state at another extreme of said prescribed range with the coupling in locked and unlocked positions respectively, the improvement comprising:

means provided on the plug for cooperation with the coupling selectively to prevent withdrawal of the plug from the cavity with the plug inserted fully into the cavity and the plug and coupling being disposed in a first relative rotational position and to allow withdrawal of the plug from the cavity with the plug inserted fully into the cavity and the plug and coupling in a second relative rotational position;

said coupling having a pair of spaced legs each having a radially outwardly facing guide edge with a curved portion and an abutting edge;

a pair of spaced legs on the plug having third and fourth facing surfaces between which the coupling legs reside, said plug rotatable relative to the coupling in a first direction with the plug and coupling in said second relative rotational position so that said curved portions of the edges guide the coupling legs between the plug legs and biasably against the third and fourth facing plug surfaces, said plug upon rotation thereof being attempted relative to the coupling in a direction opposite to the first direction with the plug and coupling in said second relative rotational position presenting the abutting edges of the coupling leg interferingly against the third and fourth plug surface to prevent rotation of the plug in the opposite direction, said plug being rotatable relative to the coupling with the lock member in the one extreme in the first direction from the second relative rotational position to the first relative rotational position, whereby with the lock member in its locked state the coupling cannot be rotated in either direction relative to the plug.

8. In a lock of the type having a lock cylinder with an internal cavity, a key operated lock plug having a keyway and rotatable in said cavity about an axis with a key in the keyway and locked against rotation in the chamber with no key in the key way and a coupling having an associated lock member that is movable upon rotation of the coupling about said axis in a first direction in a limited range between an unlocked state and a locked state wherein movement of the lock member in a first direction is prohibited, the improvement comprising:

means for joining the coupling and plug so that the plug and coupling are inseparable in a first relative rotational position about said axis and separable in a second relative rotational position;

means guide said plug rotatably relative to the coupling in the first direction in moving between the second relative rotational position and first relative rotational position; and means preventing said plug form rotating oppositely to the first direction relative to the coupling with the plug and coupling in the second relative rotational position, and whereby with no key in the keyway and the lock member in a locked state the lock member cannot be moved to its unlocked state.

* * * * *